US011761394B2

(12) United States Patent
Dudar

(10) Patent No.: US 11,761,394 B2
(45) Date of Patent: Sep. 19, 2023

(54) METHOD AND SYSTEM FOR FUEL SYSTEM

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/643,925

(22) Filed: Dec. 13, 2021

(65) Prior Publication Data

US 2023/0184184 A1 Jun. 15, 2023

(51) Int. Cl.
*F02D 41/00* (2006.01)
*F02M 25/08* (2006.01)
*F02M 35/10* (2006.01)

(52) U.S. Cl.
CPC ..... *F02D 41/004* (2013.01); *F02D 41/0035* (2013.01); *F02M 25/0809* (2013.01); *F02M 25/089* (2013.01); *F02M 25/0836* (2013.01); *F02M 25/0872* (2013.01); *F02M 35/10222* (2013.01); *F02D 41/003* (2013.01); *F02M 25/0818* (2013.01)

(58) Field of Classification Search
CPC .. F02D 41/004; F02D 41/0035; F02D 41/003; F02M 25/0818; F02M 25/0809; F02M 25/0836; F02M 25/0872; F02M 25/089; F02M 35/10222
See application file for complete search history.

(56) References Cited

U.S. PATENT DOCUMENTS

| | | | | |
|---|---|---|---|---|
| 5,826,602 | A * | 10/1998 | Chen | F02B 77/04 123/198 A |
| 6,029,635 | A * | 2/2000 | Sekine | F02M 25/089 123/520 |
| 9,217,402 | B2 | 12/2015 | Dudar et al. | |
| 9,243,592 | B2 | 1/2016 | Dudar et al. | |
| 9,458,801 | B2 | 10/2016 | Dudar et al. | |
| 9,605,610 | B2 * | 3/2017 | Dudar | F02M 25/0809 |
| 9,611,814 | B2 * | 4/2017 | Dudar | F02M 25/089 |
| 10,760,532 | B1 * | 9/2020 | Dudar | F02D 41/0032 |
| 11,041,452 | B2 * | 6/2021 | Dudar | F02D 41/0007 |
| 11,319,886 | B1 * | 5/2022 | Dudar | F02M 25/0872 |
| 2015/0083087 | A1 * | 3/2015 | Pearce | F02M 25/0809 123/520 |
| 2015/0369150 | A1 * | 12/2015 | Dudar | F02M 25/0836 123/519 |
| 2017/0260914 | A1 * | 9/2017 | Dudar | F02M 25/0854 |
| 2017/0356360 | A1 * | 12/2017 | Dudar | F02M 25/0809 |
| 2019/0107081 | A1 * | 4/2019 | Dudar | F02D 41/0037 |
| 2019/0136775 | A1 * | 5/2019 | Dudar | B60W 10/08 |
| 2020/0291879 | A1 * | 9/2020 | Dudar | F02D 41/0032 |

* cited by examiner

*Primary Examiner* — Logan M Kraft
*Assistant Examiner* — Susan E Scharpf
(74) *Attorney, Agent, or Firm* — Vincent Mastrogiacomo; McCoy Russell LLP

(57) ABSTRACT

Methods and systems are provided for a fuel system. In one example, a method may include cleaning an orifice of an ELCM. The cleaning includes adjusting a position of a valve in a passage to fluidly couple a reference orifice of the ELCM to an intake manifold.

20 Claims, 5 Drawing Sheets

METHOD AND SYSTEM FOR FUEL SYSTEM

FIELD

The present description relates generally to an evaporative leak check module (ELCM) of a fuel system.

BACKGROUND/SUMMARY

Vehicles may be fitted with evaporative emission control systems such as onboard fuel vapor recovery systems. Such systems capture and reduce release of vaporized hydrocarbons to the atmosphere, for example fuel vapors released from a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejectors, and/or controller actuatable valves for facilitating purge of stored vapors under boosted or non-boosted engine operation.

Various approaches have been developed for detecting fuel vapor leaks and/or degraded components in such fuel vapor recovery systems. One example routine for determining a leak in the fuel system includes using a vacuum pump. The vacuum pump may be activated, which in turn may evacuate a small volume comprising a reference orifice. A reference vacuum value obtained during the leak diagnostic may determine a pass/fail.

However, during real-world conditions, the reference orifice may become clogged due to dust and other contaminants. The vacuum pump may be unable to reach a threshold reference vacuum when an opening of the reference orifice is changed, resulting in false failed diagnostics. Customer satisfaction may be reduced and warranty costs may be increased due to the fouling of the vacuum pump.

In one example, the issues described above may be addressed by a method for adjusting a position of a valve in a canister bypass line in response to a request to clean an orifice of an evaporative leak control module (ELCM). In this way, the diagnostic may be executed again following the cleaning to ensure a leak is present.

As one example, an engine vacuum may draw contaminants from the ELCM to the intake manifold. The contaminants may clog the reference orifice, which may affect a pressure of the ELCM during leak tests along with other conditions. If a leak test is executed while the reference orifice is clogged or partially clogged, the pressure of the ELCM may not decrease to a threshold reference pressure based on an unclogged size of the reference orifice. This may result in a false failure of the leak diagnostic. By cleaning the reference orifice periodically or in response to a leak test not being passed, an accuracy of the leak test may be enhanced. Vehicle downtime and maintenance and/or warranty costs may be reduced, resulting in increased customer satisfaction.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
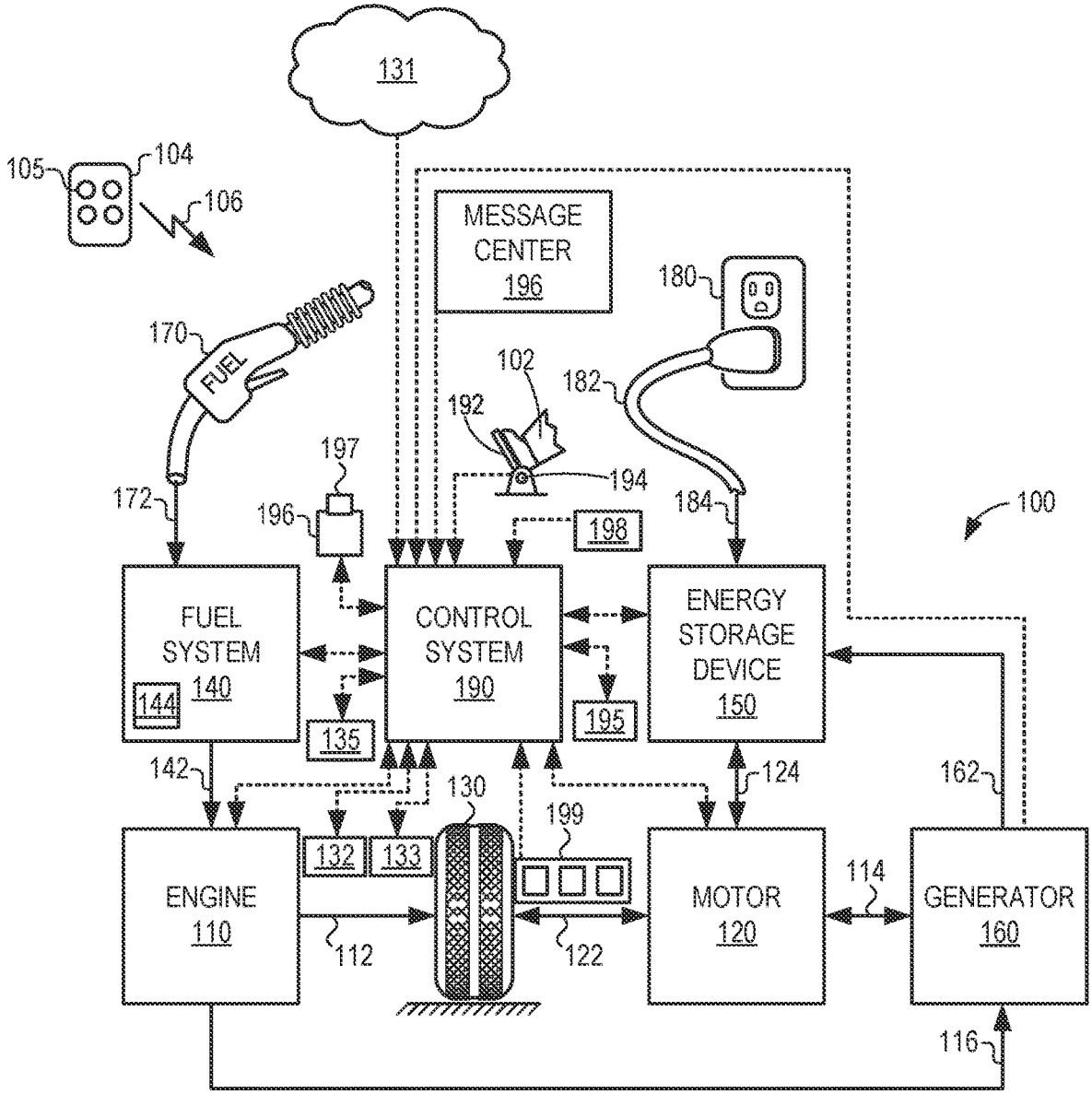
FIG. 1 illustrates a schematic of an engine included in a hybrid vehicle.
Figure 2:
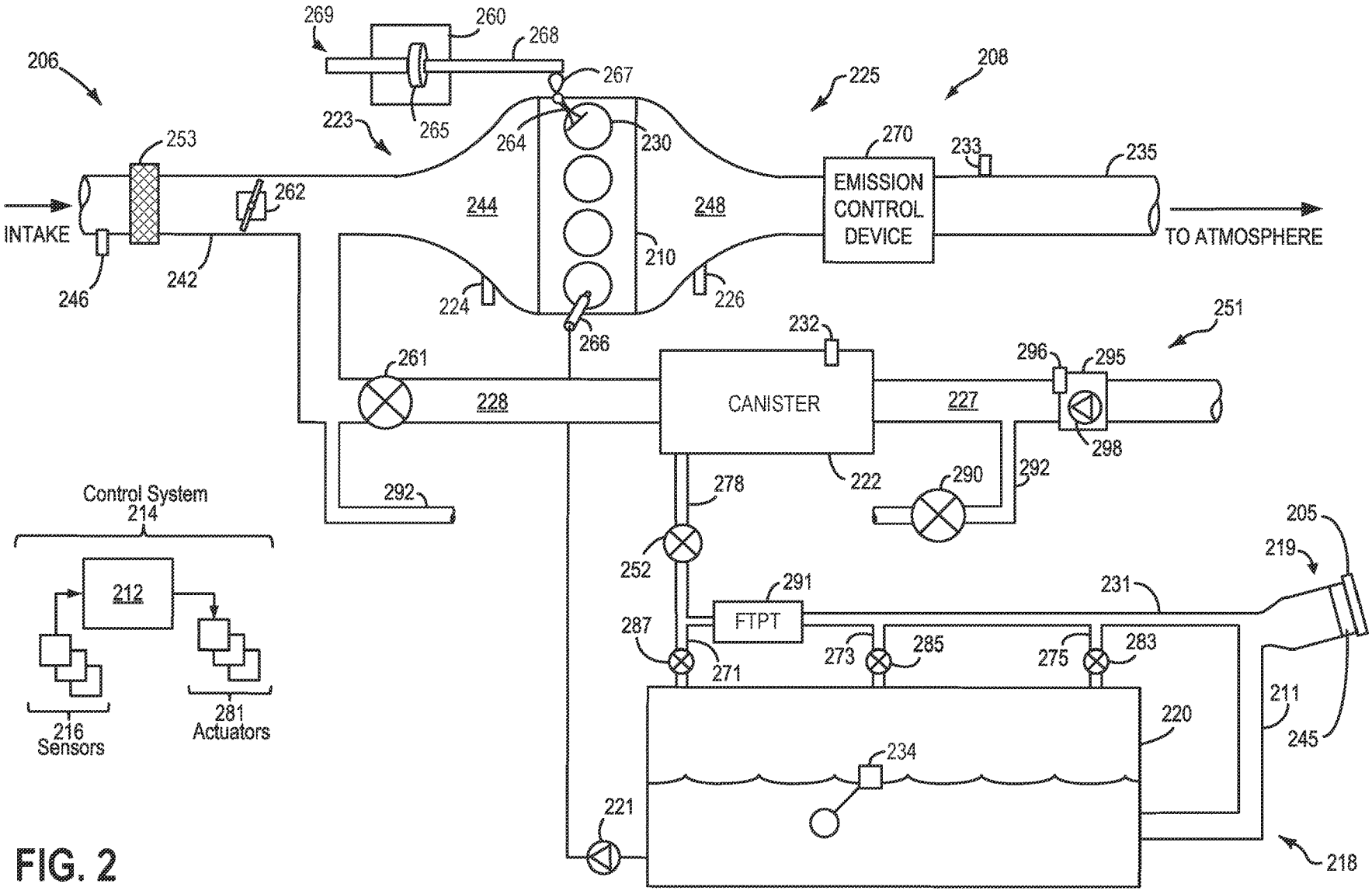
FIG. 2 illustrates a non-boosted embodiment of an engine comprising a fuel system with leak detection.
Figure 3:
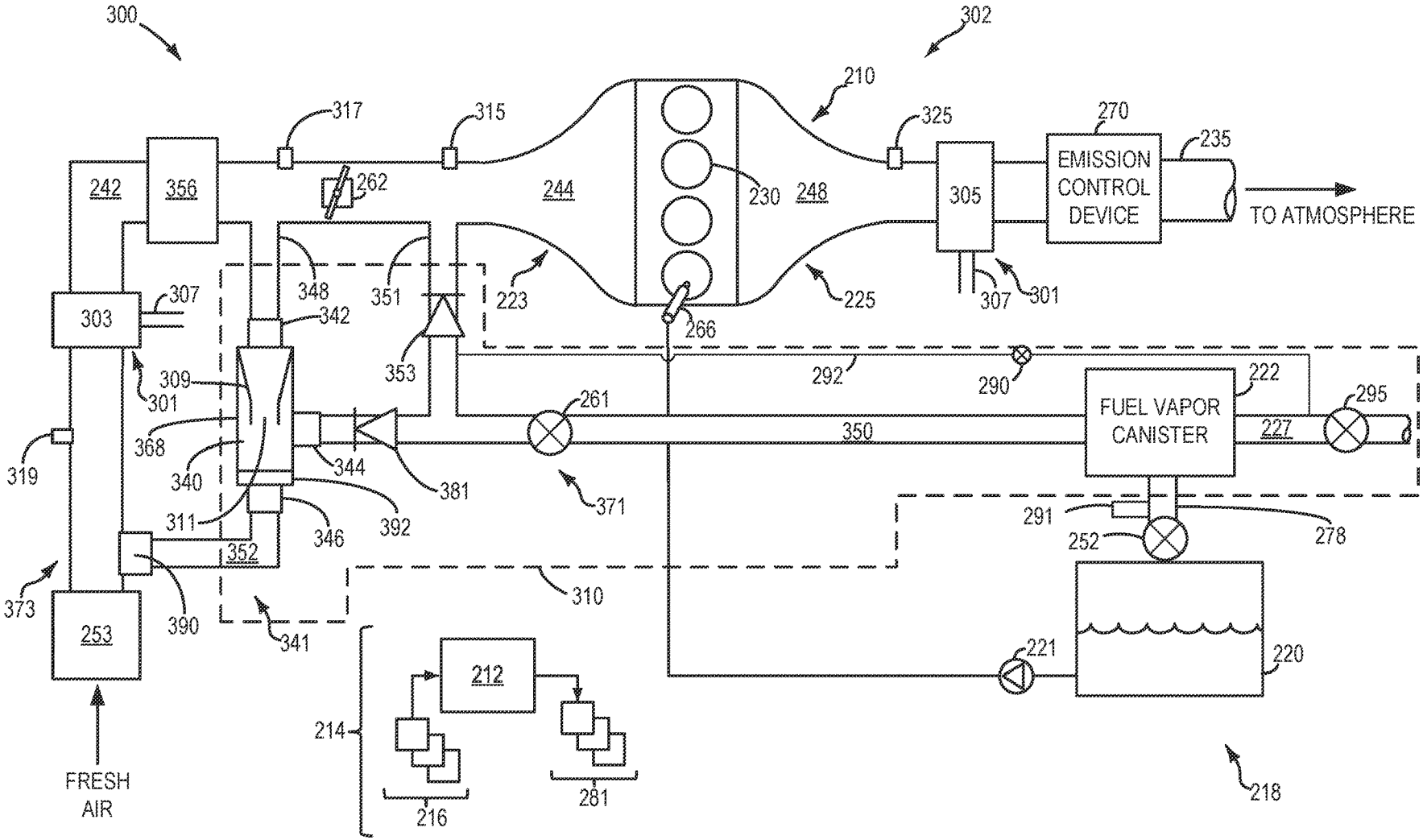
FIG. 3 illustrates a boosted embodiment of an engine comprising a fuel system with leak detection.
Figure 4B:
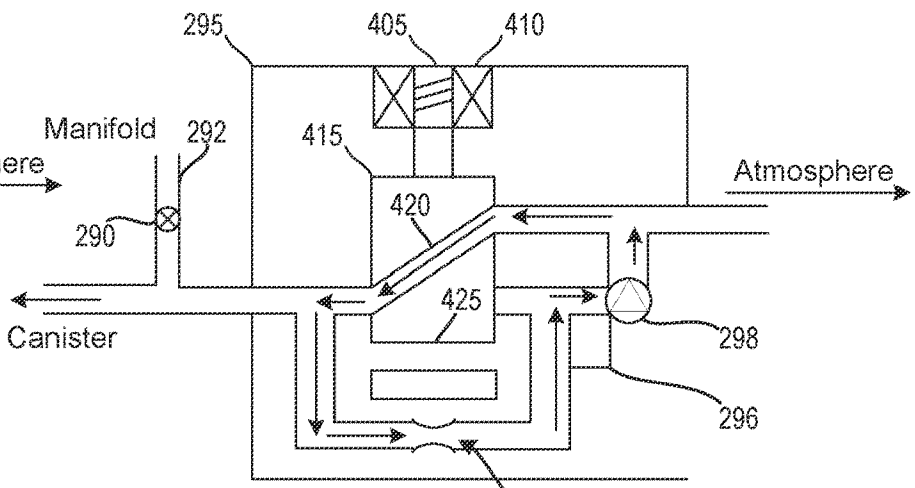
FIGS. 4A, 4B, 4C, and 4D illustrate example of an evaporative leak control module (ELCM) valve.
Figure 4A:
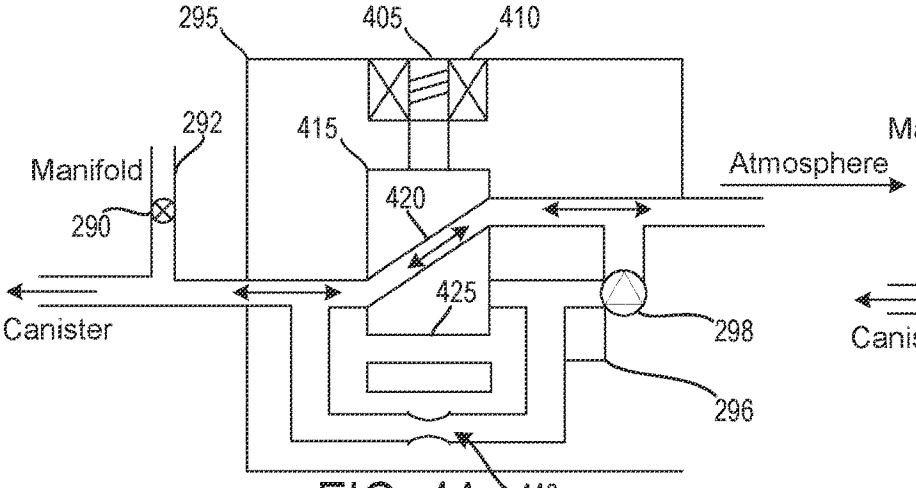
Figure 4C:
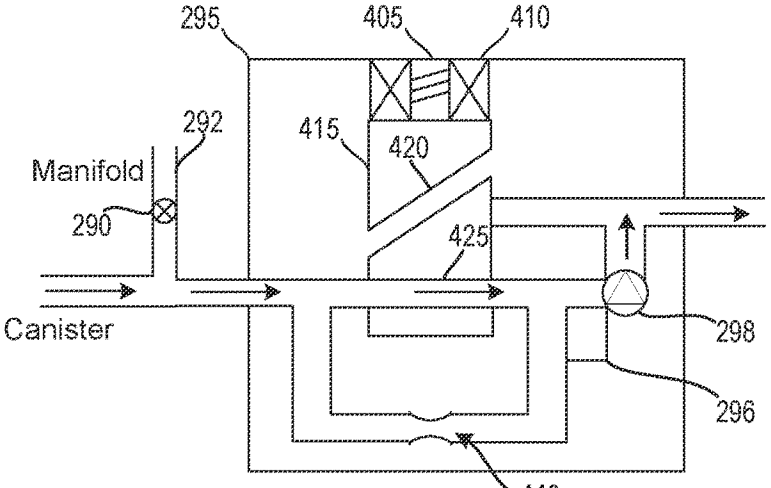
Figure 5:
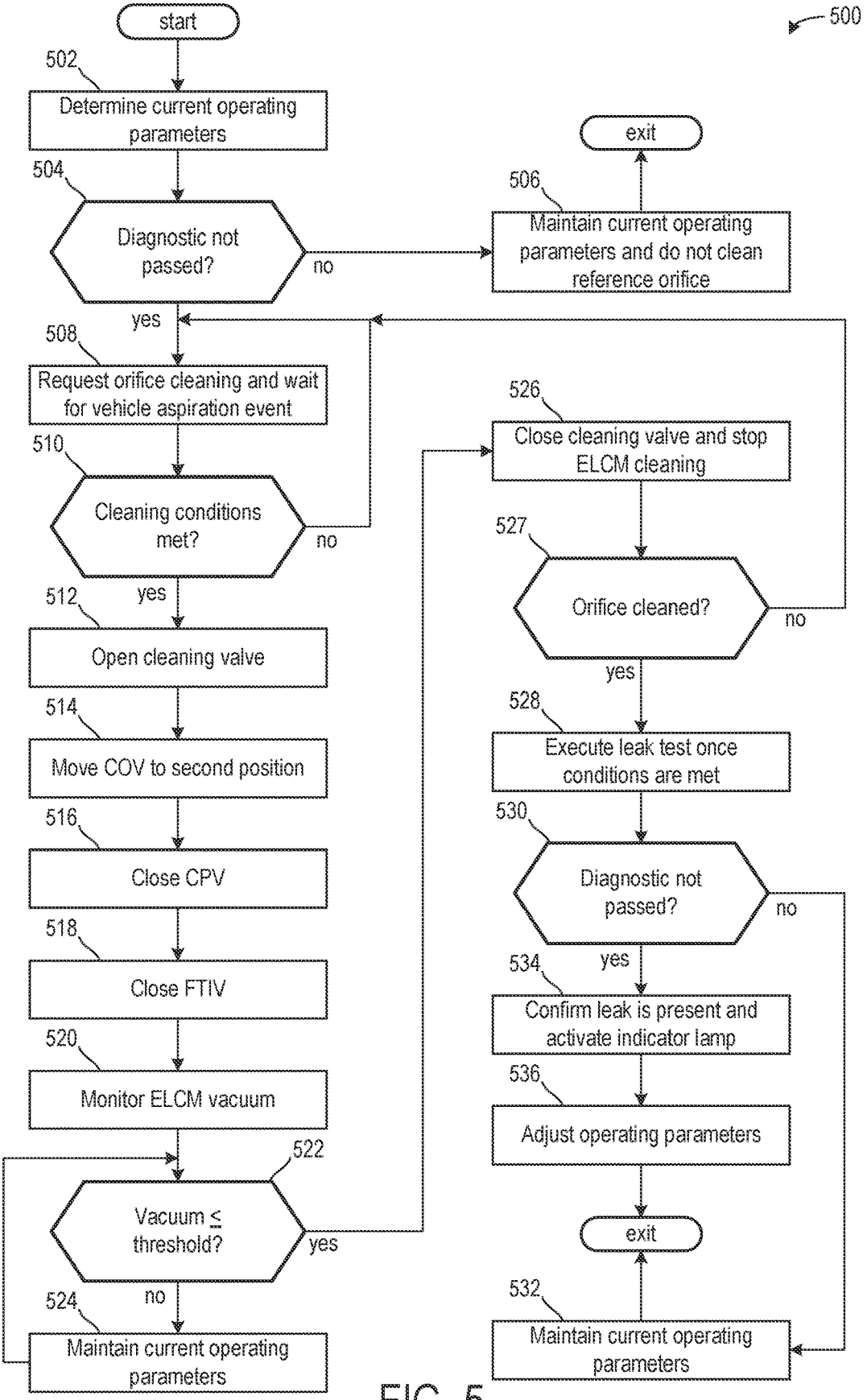
FIG. 5 illustrates a method for cleaning an orifice of the ELCM valve.

The following description relates to systems and methods for a fuel evaporative leak system. The system may be included in an engine, optionally arranged in a hybrid vehicle as illustrated in FIG. 1. The system may include a single-path or a multi-path purge in a non-boosted or a boosted engine, as shown in FIGS. 2 and 3, respectively. FIGS. 4A, 4B, and 4C show different positions of a valve of an evaporative leak control module (ELCM), one of which may be used during a cleaning of an orifice of an ELCM valve. A method for cleaning the ELCM valve is shown in FIG. 5.

FIGS. 1-4C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be automatically actuated or pressed by a vehicle operator to initiate refueling. For example, in response to the vehicle operator actuating refueling button 197, a fuel tank in the vehicle may be depressurized so that refueling may be performed.

In some examples, vehicle propulsion system 100 may include one or more onboard cameras 135. Onboard cameras 135 may communicate photos and/or video images to control system 190, for example. Onboard cameras may in some examples be utilized to record images within a predetermined radius of the vehicle, for example.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In some examples, vehicle system 100 may include lasers, radar, sonar, acoustic sensors 133, which may enable vehicle location, traffic information, etc., to be collected via the vehicle.

The vehicle system 100 may be in wireless communication with a wireless network 131. The control system 190 may communicate with the wireless network 131 via a modem, a router, a radio signal, or the like. Data regarding various vehicle system conditions may be communicated between the control system 190 and the wireless network. Additionally or alternatively, the wireless network 131 may communicate conditions of other vehicles to the control system 190.

FIG. 2 shows a schematic depiction of a vehicle system 206. The vehicle system 206 includes an engine system 208 coupled to an evaporative emissions control system 251 and a fuel system 218. Evaporative emissions control system 251 (also termed, evaporative emissions system 251) includes a fuel vapor container or fuel system canister 222 which may be used to capture and store fuel vapors. In some examples, vehicle system 206 may be a hybrid electric vehicle system, such as the vehicle propulsion system 100 of FIG. 1. As such, engine 210 may be similar to engine 110 of FIG. 1 while control system 214 of FIG. 2 may be the same as control system 190 of FIG. 1.

The engine system 208 may include an engine 210 having a plurality of cylinders 230. The engine 210 includes an engine intake 223 and an engine exhaust 225. The engine intake 223 includes a throttle 262 fluidly coupled to the intake manifold 244. Fresh intake air enters intake passage 242 and flows through air filter 253. Air filter 253 positioned in the intake passage 242 may clean intake air before the intake air is directed to the intake manifold 244. Cleaned intake air exiting the air filter 253 may stream past throttle 262 (also termed intake throttle 262) into intake manifold 244 via intake passage 242. As such, intake throttle 262 when fully opened may enable a higher level of fluidic communication between intake manifold 244 and intake passage 242 downstream of air filter 253. An amount of intake air provided to the intake manifold 244 may be regulated via throttle 262 based on engine conditions. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean $NO_x$ trap, diesel particulate filter, oxidation catalyst, etc. It will be appreciated that other components may be included in the engine such as a variety of valves and sensors.

Each cylinder 230 may be serviced by one or more valves. In the present example, each cylinder 30 includes a corresponding intake valve 264 and an exhaust valve (not shown). Each intake valve 264 may be held at a desired position via a corresponding spring. Engine system 208 further includes one or more camshafts 268 for operating intake valve 262. In the depicted example, intake camshaft 268 is coupled to intake valve 264 and can be actuated to operate intake valve 264. In some embodiments, where the intake valve of a plurality of cylinders 230 are coupled to a common camshaft, intake camshaft 268 can be actuated to operate all the intake valves of all the coupled cylinders.

Intake valve 264 is actuatable between an open position that allows intake air into the corresponding cylinder and a closed position substantially blocking intake air from the cylinder. Intake camshaft 268 may be included in intake valve actuation system 269. Intake camshaft 268 includes intake cam 267 which has a cam lobe profile for opening intake valve 264 for a defined intake duration. The lobe profile may affect cam lift height, cam duration, and/or cam timing. A controller, such as controller 212, may be able to switch the intake valve duration by moving intake camshaft 268 longitudinally and switching between cam profiles.

It will be appreciated that the intake and/or exhaust camshafts may be coupled to cylinder subsets, and multiple intake and/or exhaust camshafts may be present. Intake valve actuation system 269 may further include push rods, rocker arms, tappets, etc. As such, the intake valve actuation system may include a plurality of electromechanical actuators. Such devices and features may control actuation of the intake valve 264 by converting rotational motion of the cams into translational motion of the valves. As previously discussed, the valves can also be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 230 may each have more than one intake valve. In still other examples, each intake valve 264 of one or more cylinders may be actuated by a common camshaft. Further still, in some examples, some of the intake valves 264 may be actuated by their own independent camshaft or other device.

Engine system 208 may include variable valve timing systems, for example, variable cam timing VCT system 260. As such, VCT system 260 may be operatively and communicatively coupled to the intake valve actuation system 269. VCT system 260 may include an intake camshaft phaser 265 coupled to the common intake camshaft 268 for changing intake valve timing. VCT system 260 may be configured to advance or retard valve timing by advancing or retarding cam timing and may be controlled by controller 212. In some embodiments, valve timing such as intake valve closing (IVC) may be varied by a continuously variable valve lift (CVVL) device.

The valve/cam control devices and systems described above may be hydraulically powered, or electrically actuated, or combinations thereof. In one example, a position of the camshaft may be changed via cam phase adjustment of an electrical actuator (e.g., an electrically actuated cam phaser) with a fidelity that exceeds that of most hydraulically operated cam phasers. Signal lines can send control signals to and receive a cam timing and/or cam selection measurement from VCT system 260. As such, the valve actuation systems described above may enable closing the intake valves to block fluid flow therethrough, when desired.

Though not shown in FIG. 2, vehicle system 206 may also include an exhaust gas recirculation (EGR) system for routing a desired portion of exhaust gas from the exhaust passage 235 to the intake manifold 244 via an EGR passage. The amount of EGR provided may be varied by controller 212 via adjusting an EGR valve in the EGR passage. By introducing exhaust gas to the engine 210, the amount of available oxygen for combustion is decreased, thereby reducing combustion flame temperatures and reducing the formation of $NO_x$, for example.

Fuel system 218 may include a fuel tank 220 coupled to a fuel pump system 221. The fuel pump system 221 may include one or more pumps for pressurizing fuel delivered to the injectors of engine 210, such as the example injector 266. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to evaporative emissions control system 251, which includes a fuel vapor canister 222, via vapor recovery line 231. The fuel vapor canister 222 may also be simply termed canister 222 herein. Fuel vapors stored in fuel vapor canister 222 may be purged to the engine intake 223 at a later time. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves are included in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219 (or refueling system 219). In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Evaporative emissions control system 251 may include one or more emissions control devices, such as one or more fuel vapor canisters 222 (also termed, canister 222) filled with an appropriate adsorbent. The canisters are configured to temporarily trap fuel vapors (including vaporized hydrocarbons) during fuel tank refilling operations and "running loss" (that is, fuel vaporized during vehicle operation). In one example, the adsorbent used is activated charcoal.

Evaporative emissions system 251 may further include a canister ventilation path or vent line 227 which may route gases out of the canister 222 to the atmosphere when storing, or trapping, fuel vapors from fuel system 218.

Vent line 227 may allow fresh air to be drawn into canister 222 when purging stored fuel vapors from canister 222 to engine intake 223 via purge line 228 and canister purge valve 261 (also termed, purge valve 261). For example, purge valve 261 may be normally closed but may be opened during certain conditions so that vacuum from engine intake manifold 244 is provided to the fuel vapor canister 222 for purging.

FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may be stored within canister 222 and air, stripped off fuel vapors, may then be vented to atmosphere via vent line 227. Fuel vapors stored in fuel vapor canister 222 may be purged along purge line 228 to engine intake 223 via canister purge valve 261 at a later time when purging conditions exist. As such, FTIV 252 when closed may isolate and seal the fuel tank 220 from the evaporative emissions system 251. It will be noted that certain vehicle systems may not include FTIV 252.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252 while closing canister purge valve (CPV) 261 to direct refueling vapors into canister 222 and preventing fuel vapors from being directed into the intake manifold.

As another example, the fuel system may be operated in a refueling mode (e.g., when fuel tank refueling is requested by a vehicle operator), wherein the controller 212 may open FTIV 252, while maintaining CPV 261 closed, to depressurize the fuel tank before allowing fuel to be added therein. As such, FTIV 252 may be kept open during the refueling operation to allow refueling vapors to be stored in the canister. After refueling is completed, the FTIV may be closed.

As yet another example, the fuel system may be operated in a canister purging mode (e.g., after an emission control device light-off temperature has been attained and with the engine running), wherein the controller 212 may open CPV 261 while closing FTIV 252. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. The FTIV 252 may be closed during the purging mode.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include manifold absolute pressure (MAP) sensor 224, barometric pressure (BP) sensor 246, exhaust gas sensor 226 located in exhaust manifold 248 upstream of the emission control device, temperature sensor 233, fuel tank pressure sensor 291 (also termed a fuel tank pressure transducer or FTPT), and canister temperature sensor 232. Other sensors such as pressure, temperature, air/fuel ratio, and composition sensors may be coupled to various locations in the vehicle system 206. As another example, the actuators may include CPV 261, fuel injector 266, throttle 262, FTIV 252, fuel pump 221, and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 3, 4, 5A, 5B, and 7.

The controller 212 receives signals from the various sensors of FIG. 2 and employs the various actuators of FIG. 2 to adjust engine operation based on the received signals and instructions stored on a memory of the controller. For example, adjusting the canister purge valve may include adjusting an actuator of the canister purge valve to adjust a flow rate of fuel vapors therethrough. As such, controller 212 may communicate a signal to the actuator (e.g., canister purge valve solenoid) of the canister purge valve based on a desired purge flow rate. Accordingly, the canister purge valve solenoid may be opened (and pulsed) at a specific duty cycle to enable a flow of stored vapors from canister 222 to intake manifold 244 via purge line 228.

Leak detection routines may be intermittently performed by controller 212 on evaporative emissions system 251 and fuel system 218 to confirm that the fuel system is not degraded. In one example, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum.

Leak tests may be performed by an evaporative leak check module (ELCM) 295 communicatively coupled to controller 212. ELCM 295 may be coupled to the evaporative emissions system 251 of vehicle system 206. Further, ELCM 295 may be coupled in vent line 227, between canister 222 and the atmosphere or a dust box. ELCM 295 may include a pump 298, such as a vacuum pump, for applying negative pressure to the fuel system when administering a leak test. ELCM 295 may further include a reference orifice (shown in FIGS. 4A-4D), a changeover valve (COV) (shown in FIGS. 4A-4D), and a pressure sensor 296. The COV may be moveable between a first position and a second position. In the first position, air may flow through ELCM 295 via a first flow path. In the second position, air may flow through ELCM 295 via a second flow path. In either the first or second position, pressure sensor 296 may generate a pressure signal reflecting the pressure within ELCM 295. The position of the COV may be controlled by a solenoid via a compression spring. The reference orifice in the ELCM may have a diameter corresponding to the size of a threshold leak to be tested, for example, 0.02". As a reference check, the ELCM may be isolated from the fuel system and evaporative emissions system, and the pump activated to draw a vacuum on the reference orifice. The resulting pressure serves as a reference for leaks of equivalent size. The ELCM can then be coupled to one or both of the fuel system and the evaporative emissions system, and the pump may be activated. If the system(s) is (are) not leaking and/or if the orifice is not clogged, the reference vacuum may be attained.

In some embodiments, the pump 298 may be configured to be reversible. In other words, the pump 298 may be configured to apply either a negative pressure or a positive pressure on the evaporative emissions system and/or fuel system. Operation of pump 298 and the solenoid of the COV may be controlled via signals received from controller 212. Following the applying of vacuum (and/or positive pressure) to the evaporative emissions system or fuel system, a change in pressure at the reference orifice (e.g., an absolute change or a rate of change) may be monitored and compared to a threshold reference pressure. Based on the comparison, an evaporative emissions system leak and/or a fuel system leak or an orifice fouling may be diagnosed. As such, the evaporative emissions system alone may be tested for leaks (e.g., termed a canister side leak) by closing the FTIV 252 and isolating the fuel tank 220 from the ELCM 295.

As described above, the reference orifice of the pump 298 may become clogged, which may impact the leak diagnostics. A cleaning valve 290 may be arranged in a canister bypass line 292, which may intersect with the purge line 228 between the intake passage 242 and the CPV 261 at a first intersection. The canister bypass line 292 may intersect with the vent line 227 between the canister 222 and the ELCM 295 at a second intersection. A position of the cleaning valve 290 may be adjusted in response a request to clean the reference orifice of the ELCM 295. The request may be generated in response to a pressure of the ELCM being greater than the threshold reference pressure, which may occur during a leak diagnostic or other conditions. Additionally or alternatively, the cleaning request may be generated periodically based on a number of miles driven, an amount of time elapsed, or a volume of fuel consumed. The controller 212 may signal to an actuator of the cleaning valve 290 to move to a more open position to flow vacuum from the engine intake 223 to the ELCM 295. During the cleaning, the CPV 261 may be closed and the FTIV 252 may be closed. The cleaning operation of the ELCM 295 is described in greater detail below with respect to FIGS. 4A-5.

FIG. 3 shows a schematic depiction of a vehicle system 300. The vehicle system 300 may be a non-limiting example of the vehicle system 206 of FIG. 2. Components previously introduced in the vehicle system 206 are similarly numbered in the vehicle system 300 and are not reintroduced for reasons of brevity. The vehicle system 300 may be differentiated from the vehicle system 206 of FIG. 2 in that vehicle system 300 includes a dual-path purge configuration whereas vehicle system 206 includes a single-path purge configuration. However, the method and valve positions described below may be applicable to both the vehicle system 206 of FIG. 2 and vehicle system 300 of FIG. 3.

The vehicle system 300 includes an engine system 302 coupled to a fuel vapor recovery system 310 and the fuel system 218. The fuel vapor recovery system may also be referred to as a fuel vapor purging system.

Throttle 262 may be located in intake passage 242 downstream of a compressor 303 of a boosting device, such as turbocharger 301, or a supercharger. Compressor 303 of turbocharger 301 may be arranged between air filter 253 and throttle 262 in intake passage 242. Compressor 303 may be at least partially powered by exhaust turbine 305, arranged between exhaust manifold 248 and emission control device 270 in exhaust passage 235. Compressor 303 may be coupled to exhaust turbine 305 via shaft 307. Compressor 303 may be configured to draw in intake air at atmospheric air pressure into an air induction system (AIS) 373 and boost it to a higher pressure (e.g., higher than atmospheric pressure). Using the boosted intake air, a boosted engine operation may be performed.

An amount of boost may be controlled, at least in part, by controlling an amount of exhaust gas directed through exhaust turbine 305. In one example, when a larger amount of boost is requested, a larger amount of exhaust gases may be directed through the turbine. Alternatively, for example when a smaller amount of boost is requested, some or all of the exhaust gas may bypass turbine via a turbine bypass passage as controlled by wastegate (not shown). An amount of boost may additionally or optionally be controlled by controlling an amount of intake air directed through compressor 303. Controller 212 may adjust an amount of intake air that is drawn through compressor 303 by adjusting the position of a compressor bypass valve (not shown). In one example, when a larger amount of boost is requested, a smaller amount of intake air may be directed through the compressor bypass passage.

Vapors generated in fuel system 218 may be routed to fuel vapor recovery system 310, described further below, via conduit 278, before being purged to the engine intake 223. Fuel vapor recovery system 310 includes a fuel vapor retaining device, depicted herein as fuel vapor canister 222. Canister 222 may be filled with an adsorbent capable of binding large quantities of vaporized HCs. In one example, the adsorbent used is activated charcoal. Canister 222 may receive fuel vapors from fuel tank 220 through conduit 278. While the depicted example shows a single canister, it will be appreciated that in alternate embodiments, a plurality of such canisters may be connected together. Canister 222 may communicate with the atmosphere through vent 227. An evaporative leak check module (ELCM) 295 may be disposed in vent 227 and may be configured to control venting and/or assist in leak detection.

Conduit 278 may include a fuel tank pressure transducer (FTPT) 291. Specifically, FTPT 291 may monitor the pressure in the fuel tank. The fuel tank 220 may hold a plurality of fuel blends, including fuel with a range of alcohol concentrations, such as various gasoline-ethanol blends, including E10, E85, gasoline, etc., and combinations thereof.

Fuel vapor canister 222 operates to store vaporized hydrocarbons (HCs) from fuel system 218. Under some operating conditions, such as during refueling, fuel vapors present in the fuel tank may be displaced when liquid is added to the tank. The displaced air and/or fuel vapors may be routed from the fuel tank 220 to the fuel vapor canister 222, and then to the atmosphere through vent 227. In this way, an increased amount of vaporized HCs may be stored in fuel vapor canister 222. During a later engine operation, the stored vapors may be released back into the incoming air charge via fuel vapor recovery system 310.

Fuel vapor recovery system 310 may include a dual path purge system 371. Purge system 371 is coupled to canister 222 via a conduit 350. Then, conduit 350 may be coupled to an ejector 340 in an ejector system 341, as shown in FIG. 3. The CPV 261 may control an amount of gas exiting the canister 222 toward the intake manifold 244 and the ejector 340.

A conduit 351 couples conduit 350 to intake 223 at a position downstream of throttle 262. Specifically, a first end of conduit 351 is coupled directly to CPV 261 and an opposite, second end of conduit 351 is coupled directly to the intake 223 at a position downstream of throttle 262. For example, conduit 351 may be used to direct fuel from canister 222 to intake 242 using vacuum generated in intake manifold 244 during a purge event. As another example, conduit 351, in combination with canister bypass passage 292, may be used to flow contaminants from the reference orifice of the ELCM to the intake manifold 244 via engine vacuum. Conduit 351 may include a check valve 353 disposed therein. Check valve (e.g., one-way check valve) 353 may prevent intake air from flowing through from intake manifold 244 into conduit 350, while allowing flow of fluid and fuel vapors from conduit 350 into intake manifold 244 via conduit 351 during a canister purging event. The check valve 353 may be further configured to block intake air from flowing to the ELCM during the cleaning mode.

A second check valve 381 may be arranged in a second flow path between the ejector 340 and the CPV 261. The second check valve 381 may block intake air from flowing through the ejector and into conduit 350, while allowing flow of fluid and fuel vapors from conduit 350 into ejector 340.

Conduit 348 may be coupled to ejector 340 at a first port or inlet 342. Ejector 340 includes a second port 344 or inlet coupling ejector 340 to conduit 350 via CPV 261. Ejector 340 is coupled to intake 223 at a position upstream of throttle 262 and downstream of compressor 303 via the conduit 348 relative to a direction of gas flow. During boost conditions, conduit 348 may direct compressed air in intake passage 242 downstream of compressor 303 into ejector 340 via port 342.

Ejector 340 may also be coupled to intake passage 242 at a position upstream of compressor 303 via a shut-off valve 390. In one example, shut-off valve 390 is hard-mounted directly to air induction system 373 along intake passage 242 at a position between air filter 253 and compressor 303. For example, shut-off valve 390 may be coupled to an existing AIS nipple or other orifice, e.g., an existing SAE male quick connect port, in AIS 373. As shown in FIG. 3, a further shut-off valve 392 is coupled to a third port 346 or outlet of ejector 340. Shut-off valve 392 is configured to close in response to leaks detected downstream of outlet 346 of ejector 340. As shown in FIG. 3, in some examples, a conduit or hose 352 may couple the third port 346 or outlet of ejector 340 to shut-off valve 390. In this example, if a disconnection of shut-off valve 390 with AIS 373 is detected, then shut-off valve 392 may close so air flow from the engine intake downstream of the compressor through the converging orifice in the ejector is discontinued. However, in other examples, shut-off valve 390 may be integrated with ejector 340 and directly coupled thereto. In yet other examples, the ejector system 341 may not include shut-off valve 390. In an alternate embodiment, the fuel vapor recovery system may not include an ejector and the CPV 261 may be directly coupled to the intake passage, upstream of compressor 303, via a conduit only.

Ejector 340 includes a housing 368 coupled to ports 346, 344, and 342. In one example, only the three ports 346, 344, and 342 are included in ejector 340. Ejector 340 may include various check valves disposed therein. For example, in some examples, ejector 340 may include a check valve positioned adjacent to each port in ejector 340 so that unidirectional flow of fluid or air is present at each port. For example, air from intake passage 242 downstream of compressor 303 may be directed into ejector 340 via inlet port 342 and may flow through the ejector and exit the ejector at outlet port 346 before being directed into intake passage 242 at a position upstream of compressor 303. This flow of air through the ejector may create a vacuum due to the Venturi effect at inlet port 344 so that vacuum is provided to conduit 350 via port 344 during boosted operating conditions. In particular, a low pressure region is created adjacent to inlet port 344 which may be used to draw purge vapors from the canister into ejector 340.

Ejector 340 includes a nozzle 309 comprising an orifice 311 which converges in a direction from inlet 342 toward suction inlet 344 so that when air flows through ejector 340 in a direction from port 342 towards port 346, a vacuum is created at port 344 due to the Venturi effect. This vacuum may be used to assist in fuel vapor purging during certain conditions, e.g., during boosted engine conditions. In one example, ejector 340 is a passive component. That is, ejector 340 is designed to provide vacuum to the fuel vapor purge system via conduit 350 to assist in purging under various conditions, without being actively controlled. Thus, whereas CPV 261 and throttle 262 may be controlled via controller 212, for example, ejector 340 may be neither controlled via controller 212 nor subject to any other active control. In another example, the ejector may be actively controlled with a variable geometry to adjust an amount of vacuum provided by the ejector to the fuel vapor recovery system via conduit 350.

The operation of ejector 340 within fuel vapor purging system 310 during vacuum conditions will now be described. The vacuum conditions may include intake manifold vacuum conditions. For example, intake manifold vacuum conditions may be present during an engine idle condition, with manifold pressure below atmospheric pressure by a threshold amount. This vacuum in the intake system 223 may draw fuel vapor from the canister through conduits 350 and 351 into intake manifold 244. Further, at least a portion of the fuel vapors may flow from conduit 350 into ejector 340 via port 344. Upon entering the ejector via port 344, the fuel vapors may flow through nozzle 309 from toward port 342. Specifically, the intake manifold vacuum causes the fuel vapors to flow through orifice 311. Because the diameter of the area within the nozzle gradually increases in a direction from port 344 towards port 342, the fuel vapors flowing through the nozzle in this direction diffuse, which raises the pressure of the fuel vapors. After passing through the nozzle, the fuel vapors exit ejector 340 through first port 342 and flow through duct 348 to intake passage 242 and then to intake manifold 244.

Next, the operation of ejector 340 within fuel vapor purging system 310 during boost conditions will be described. The boost conditions may include conditions during which the compressor is in operation. For example, the boost conditions may include one or more of a high engine load condition and a super-atmospheric intake condition, with intake manifold pressure greater than atmospheric pressure by a threshold amount.

Fresh air enters intake passage 242 at air filter 253. During boost conditions, compressor 303 pressurizes the air in intake passage 242, such that intake manifold pressure is positive. Pressure in intake passage 242 upstream of compressor 303 is lower than intake manifold pressure during operation of compressor 303, and this pressure differential induces a flow of fluid from intake passage 242 through conduit 348 and into ejector 340 via the first ejector inlet 342. This fluid may include a mixture of air and fuel, for example. After the fluid flows into the ejector via the first port 342, it flows through the converging orifice 311 in nozzle 309 in a direction from port 342 towards outlet 346. Because the diameter of the nozzle gradually decreases in a direction of this flow, a low pressure zone is created in a region of orifice 311 adjacent to suction inlet 344. The pressure in this low pressure zone may be lower than a pressure in conduit 350. When present, this pressure differential provides a vacuum to conduit 350 to draw fuel vapor from canister 222. This pressure differential may further induce flow of fuel vapors from the fuel vapor canister, through the CPV, and into port 344 of ejector 340. Upon entering the ejector, the fuel vapors may be drawn along with the fluid from the intake manifold out of the ejector via outlet port 346 and into intake 242 at a position upstream of compressor 303. Operation of compressor 303 then draws the fluid and fuel vapors from ejector 340 into intake passage 242 and through the compressor. After being compressed by compressor 303, the fluid and fuel vapors flow through charge air cooler 356, for delivery to intake manifold 244 via throttle 262.

Vehicle system 300 may further include a control system 214. Control system 214 is shown receiving information from a plurality of sensors 216 (various examples of which are described herein) and sending control signals to a plurality of actuators 281 (various examples of which are described herein). As one example, sensors 216 may include an exhaust gas sensor 325 (located in exhaust manifold 248 which may be used to estimate an air-fuel ratio of the engine, in one example) and various temperature and/or pressure sensors arranged in intake system 223. For example, a pressure or airflow sensor 315 in intake passage 242 downstream of throttle 262, a pressure or air flow sensor 317 in intake passage 242 between compressor 303 and throttle 262, and a pressure or air flow sensor 319 in intake passage 242 upstream of compressor 303. Other sensors such as additional pressure, temperature, air/fuel ratio, and composition sensors may be coupled to various locations in the vehicle system 300. As another example, actuators 281 may include fuel injectors 266, throttle 262, compressor 303, a fuel pump of pump system, etc. The control system 214 may include an electronic controller 212. The controller may receive input data from the various sensors, process the input data, and trigger the actuators in response to the processed input data based on instruction or code programmed therein corresponding to one or more routines.

FIGS. 4A, 4B, and 4C illustrate different positions of the ELCM 295. The ELCM 295 is arranged along a vent line (e.g., vent line 227 of FIGS. 2, 3) between a canister and an atmosphere. Additionally or alternatively, the ELCM 295 may be arranged between the canister and a dust box, wherein the dust box is configured to trap dust, particulates, and other contaminants. The ELCM 295 may comprise a changeover valve (COV) 415, a pump 298, and a pressure sensor 296. Pump 298 may be a reversible pump, for example, a vane pump. COV 415 may be moveable between a first position and a second position. FIGS. 4A and 4B illustrate the COV 415 in the first position, where air may flow through the ELCM 295 via a first flow path 420. FIG. 4C illustrates the COV 415 in the second position, where air may flow through the ELCM 295 via a second flow path 425. The position of the COV 415 may be controlled by solenoid 410 via compression spring 405. ELCM 295 may further include a reference orifice 440. The reference orifice 440 may include a diameter corresponding to the size of a threshold for undesired evaporative emissions to be tested, for example, 0.02 inches. In either the first or second position, the pressure sensor 296 may generate a pressure signal reflecting the pressure within ELCM 295. Operation of pump 298 and solenoid 410 may be controlled via signals received from a controller (e.g., controller 212 of FIGS. 2 and 3). Gas/particulate flow in each of FIGS. 4A-4D is illustrated via arrows.

As shown in FIG. 4A, COV 415 is in the first position, and pump 298 is deactivated. This configuration allows air to freely flow between the atmosphere and the canister. This configuration may be used during a canister purging operation, for example, and may additionally be used during vehicle operation when purging operation is not being conducted, and when the vehicle is not in operation. The cleaning valve 290 is in a closed position.

As shown in FIG. 4B, the COV 415 is in the first position, and pump 298 is activated in a first direction. The pump 298 may draw vacuum on reference orifice 440, and pressure sensor 296 may detect the vacuum level within ELCM 295. This reference check vacuum level reading may become the threshold for the presence or absence of undesired evaporative emissions in a subsequent evaporative emissions test diagnostic. The cleaning valve 290 is in the closed position.

As shown in FIG. 4C, the COV 415 is in the second position and pump 298 is activated in the first direction. This configuration allows pump 298 to draw a vacuum on the fuel system and evaporative emissions system (e.g., fuel system 218 and evaporative emissions system 251 of FIG. 2). The FTIV (e.g., FTIV 252 of FIG. 2) may be opened to allow the pump 298 to draw a vacuum on the fuel tank (e.g., fuel tank 220 of FIG. 2). As the pump 298 pulls a vacuum on the fuel tank, the absence of undesired evaporative emissions in the system may allow for the vacuum level in the ELCM 295 to reach or exceed the previously determined reference vacuum threshold. In the presence of undesired evaporative emissions larger than the reference orifice, the pump may not pull down to the reference vacuum threshold (e.g., the pressure of the ELCM is above the reference vacuum threshold). The cleaning valve 290 is in the closed position.

In another example, the pump 298 may be activated in the second direction, opposite the first direction. As such, the direction of air flow through the ELCM may be reversed. The pump 298 may draw atmospheric air and push vapors from the canister to the fuel tank.

Figure 4D:
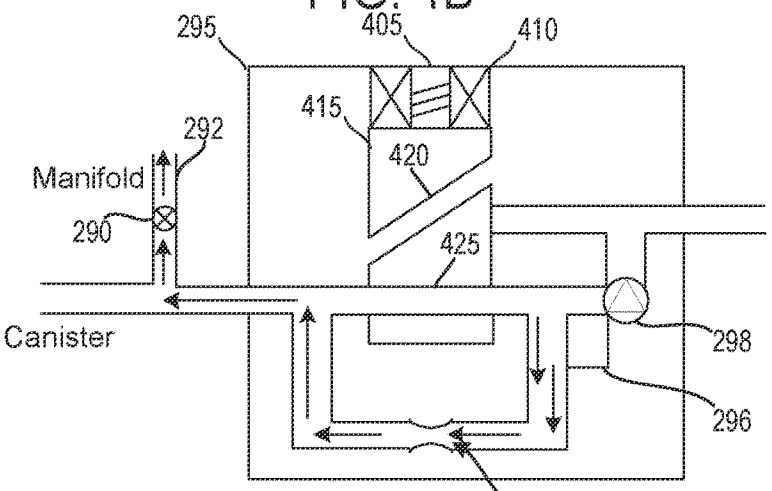

As shown in FIG. 4D, the COV 415 is in the second position and pump 298 is deactivated. The cleaning valve 290 is in an open position and vacuum from the manifold flows to the ELCM 295. As such, gases in the ELCM 295 flow through the orifice, which may sweep debris and other contaminants therefrom to the manifold. The pressure sensor 296 may sense a level of vacuum in the ELCM 295 during a cleaning of the orifice. The cleaning may be deactivated in response to the pressure being equal to or less than the reference vacuum threshold. During the cleaning mode, the FTIV and the canister purge valve may be closed. A method for executing the cleaning mode is described in greater detail with respect to FIG. 5.

Turning now to FIG. 5, it shows a method for cleaning the orifice of the ELCM in response to a diagnostic not being passed. Instructions for carrying out method 500 may be executed by a controller based on instructions stored on a memory of the controller and in conjunction with signals received from sensors of the engine system, such as the sensors described above with reference to FIGS. 1-3. The controller may employ engine actuators of the engine system to adjust engine operation, according to the methods described below.

The method 500 begins at 502, which may include determining, estimating, and/or measuring current operating parameters. Current operating parameters may include, but are not limited to, one or more of a throttle position, an intake manifold pressure, an engine speed, an engine temperature, a vehicle speed, an EGR flow rate, and an air/fuel ratio.

At 504, the method 500 may include determining if a leak diagnostic is not passed. As described above with respect to FIG. 4C, the pump is activated in a first direction and generates a vacuum within the ELCM during the leak diagnostic. The pressure sensor may sense a pressure of the ELCM at the reference orifice to determine if a leak is present. However, the pressure of the ELCM may not reach a threshold reference pressure due to a leak being present and/or a size of the reference orifice being reduced due to fouling. If a leak is not present and the size of the reference orifice is relatively unchanged, then the pressure of the ELCM may be less than or equal to the threshold reference pressure and the diagnostic may be passed.

If the diagnostic is passed, then at 506, the method 500 may include maintaining current operating parameters and not requesting a cleaning of the reference orifice.

If the diagnostic is not passed, then at 508, the method 500 may include requesting an orifice cleaning and waiting for a vehicle aspiration event including a high intake vacuum. An example of a vehicle aspiration event may include engine idle. In some examples, such as in vehicles that include a start/stop feature, the start/stop feature may be disabled if an ELCM cleaning is requested. As such, when the vehicle reaches a stop, the engine may not be deactivated and continues to combust, thereby operating at idle.

At 510, the method 500 may include determining if cleaning conditions are met. A manifold pressure sensor may detect a manifold pressure, which may be compared to a target value. If cleaning conditions are not met, then the method 500 may continue to wait for cleaning conditions to be met.

If cleaning conditions are met, then at 512, the method 500 may include opening the cleaning valve. As such, the canister bypass line may fluidly couple the intake manifold directly to the ELCM. In one example, the cleaning valve may be moved to a partially open position. For example, the cleaning valve may be moved from a fully closed position (e.g., 0% open) to a partially open position between 0 and 100% open. In one example, the partially open position during the cleaning is between 5-85% open. Additionally or alternatively, the partially open position during the cleaning is between 10-50%, 15-40%, or 20-30%. A controller may signal to an actuator of the cleaning valve to adjust a position of the cleaning valve to a desired position, the desired position determined via data stored in a multi-input look-up table where inputs include a manifold vacuum and pressure generated in the ELCM during a prior leak test. In one example, a magnitude of the opening of the cleaning valve may be inversely proportional to the vacuum of the intake manifold. As the intake manifold vacuum increases, the magnitude of the opening may decrease. As such, a vacuum level provided to the ELCM may be controlled. Additionally or alternatively, the magnitude of the opening may be based on the pressure generated in the ELCM during the prior leak test. Less vacuum (e.g., higher pressure) generated may correspond to a higher magnitude of fouling, which may demand a greater amount of vacuum for cleaning. Thus, the cleaning valve may be moved to a more open position in response to less vacuum being generated during the prior leak test.

At 514, the method 500 may include moving the COV to the second position. As such, gases may flow through the second flow path of the ELCM. The controller may signal to an actuator of the COV to actuate the COV to the second position. In one example, the controller may no longer power the actuator of the COV and a resilient member of the COV, such as a spring, may force the COV to the second position.

At 516, the method 500 may include closing the CPV. By closing the CPV, the canister may be sealed from the manifold. The controller may signal to the actuator of the CPV to actuate the CPV to the fully closed position. As such, vacuum from the engine is forced through the canister bypass line to the ELCM.

At 518, the method 500 may include closing the FTIV. The controller may signal to an actuator of the FTIV to move the FTIV to the fully closed position. By closing the FTIV, vacuum from the engine may not flow to the fuel tank.

At 520, the method 500 may include monitoring the ELCM vacuum. The ELCM vacuum may be monitored via the pressure sensor. The ELCM vacuum may be compared to the threshold reference pressure. In one example, the threshold vacuum is equal to −2 pounds per square inch (psi). Thus, if the vacuum exceeds the threshold vacuum (e.g., less than −2 psi) then the cleaning may be stopped. Additionally or alternatively, the threshold vacuum may be based on the threshold reference pressure.

At 522, the method 500 may include determining if the vacuum is less than or equal to the threshold vacuum. If the vacuum is not less than the threshold vacuum, then at 524, the method 500 may include maintaining current operating parameters and continuing cleaning the orifice via flowing vacuum from the manifold to the ELCM.

In some examples, if the cleaning has elapsed for a determined duration of time and the pressure in the ELCM does decrease to be equal to or less than the threshold vacuum, then it may be determined that a leak is present in the ELCM and the no pass result of a previous leak test was not due to a fouled orifice.

If the vacuum is less than or equal to the threshold vacuum, then at 526, the method 500 may include closing the cleaning valve and stopping the ELCM cleaning. By closing the cleaning valve, the ELCM is no longer fluidly coupled to the manifold, blocking vacuum from flowing to the ELCM.

At 527, the method 500 may include determining if the orifice is clean. The orifice may be clean if the cleaning occurred for a threshold duration, wherein the threshold duration may be empirically determined. Additionally or alternatively, a pressure test (e.g., a leak test) may be conducted to determine if a pressure of the ELCM reaches the threshold reference pressure. If the orifice is not clean, then the cleaning may be executed again. In some examples, step 527 may be omitted, wherein the reference orifice is known to be clean in response to the pressure (e.g., vacuum) being less than or equal to the threshold vacuum.

If the orifice is clean, then at 528, the method 500 may include executing the leak test once conditions are met.

At 530, the method may include determining if the leak test is not passed. If the leak test is passed, then at 532, the method 500 may include maintaining current operating parameters and does not adjust operating parameters.

If the leak test is not passed, then the high pressure (e.g., low vacuum) during the leak test may not be attributed to a fouled orifice. As such, the leak previously determined is confirmed to be present since the vacuum did not reach the threshold vacuum. At 534, the method 500 may include confirming a leak is present and activating an indicator lamp.

At 536, the method 500 may include adjusting operating parameters. In one example, purging may be limited. As another example, engine power output may be reduced. As a further example, the pump may be operated in the second direction to generate positive pressure in the system to mitigate an amount of leaking until the leak is corrected.

In this way, a diagnostic of a fuel vapor system may be improved. An orifice of an ELCM may be cleaned following a leak test not being passed. In some examples, the orifice may be cleaned following each leak test not preceded by the orifice being cleaned. Additionally or alternatively, the orifice may be cleaned periodically based on a distance traveled, amount of fuel vapor directed to the manifold, and/or based on a pressure difference between the reference pressure and a generated pressure. The technical effect of cleaning the orifice of the ELCM is to improve fuel vapor line diagnostics, which may increase customer satisfaction and reduce maintenance costs.

The disclosure also provides support for a method including adjusting a position of a valve in a canister bypass line in response to a request to clean an orifice of an evaporative leak control module (ELCM). In a first example of the method, adjusting the position of the valve comprises adjusting the valve to an open position, further comprising flowing vacuum from an intake manifold to the ELCM. In a second example of the method, optionally including the first example, adjusting the position of the valve to the open position further comprises closing a canister purge valve arranged between a canister and the intake manifold. In a third example of the method, optionally including one or both of the first and second examples, the method further comprises: adjusting a fuel tank isolation valve (FTIV) to a closed position, wherein the FTIV is arranged between the canister and a fuel tank. In a fourth example of the method, optionally including one or more or each of the first through third examples, the method further comprises: deactivating a pump of the ELCM. In a fifth example of the method, optionally including one or more or each of the first through fourth examples, adjusting the position of the valve comprising adjusting the valve to a closed position in response to a vacuum of the ELCM being less than or equal to a threshold vacuum. In a sixth example of the method, optionally including one or more or each of the first through fifth examples, the method further comprises generating the request to clean the orifice of the ELCM in response to a vacuum of the ELCM being greater than a threshold vacuum. In a seventh example of the method, optionally including one or more or each of the first through sixth examples, the method further comprises: drawing contaminants to the intake manifold. In an eighth example of the method, optionally including one or more or each of the first through seventh examples, the adjusting occurs during engine idle.

The disclosure also provides support for a system including a fuel system comprising a fuel tank and a fuel vapor canister, a fuel tank isolation valve (FTIV) arranged between the fuel vapor canister and the fuel tank, a canister purge valve (CPV) arranged between the fuel vapor canister and an intake manifold of an engine, an evaporative leak control module (ELCM) arranged between the fuel vapor canister and an ambient atmosphere, a canister bypass passage arranged between the ELCM and the intake manifold, wherein a cleaning valve is arranged in the canister bypass passage, and a controller comprising computer-readable instructions stored on non-transitory memory thereof that when executed cause the controller to: adjust a position of the cleaning valve to a partially open position in response to a vacuum of the ELCM being greater than a threshold reference vacuum. In a first example of the system, contaminants from the ELCM flow to the intake manifold via an engine vacuum during an engine vacuum event. In a second example of the system, optionally including the first example, the engine vacuum event is an engine idle. In a third example of the system, optionally including one or both of the first and second examples, the system further comprises: a pressure sensor arranged in the ELCM and configured to sense a pressure of the ELCM, and wherein the position of the cleaning valve is adjusted to a fully closed position in response to the vacuum of the ELCM being less than or equal to the threshold reference vacuum. In a fourth example of the system, optionally including one or more or each of the first through third examples, the instructions further enable the controller to close the FTIV and the CPV. In a fifth example of the system, optionally including one or more or each of the first through fourth examples, the instructions further enable the controller to adjust the position of the cleaning valve to the partially open position in response to a leak test not being passed.

The disclosure also provides support for a system for an engine including an evaporative leak check module (ELCM) arranged between a canister and an atmosphere or a dust box, a passage extending from a vent line to an intake manifold, wherein the vent line is arranged between the ELCM and the canister, a valve arranged in the passage configured to connect a reference orifice of the ELCM to the intake manifold, and a controller comprising computer-readable instructions stored on non-transitory memory thereof that when executed cause the controller to: adjust a position of the valve to flow vacuum from the intake manifold to the ELCM. In a first example of the system, the instructions further cause the controller to adjust the position of the valve in response to a leak test not being passed. In a second example of the system, optionally including the first example, the instructions further cause the controller to adjust the position of the valve to a partially open position. In a third example of the system, optionally including one or both of the first and second examples, the instructions further cause the controller to adjust the position of the valve to a closed position in response to a pressure of the ELCM being less than or equal to a threshold reference pressure. In a fourth example of the system, optionally including one or more or each of the first through third examples, the instructions further cause the controller to execute a leak test following adjusting the position of the valve to the closed position.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting a position of a valve in a canister bypass line in response to a request to clean an orifice of an evaporative leak control module (ELCM).

2. The method of claim 1, wherein adjusting the position of the valve comprises adjusting the valve to an open position, the method further comprising flowing vacuum from an intake manifold to the ELCM.

3. The method of claim 2, wherein adjusting the position of the valve to the open position further comprises closing a canister purge valve arranged between a canister and the intake manifold.

4. The method of claim 3, further comprising adjusting a fuel tank isolation valve (FTIV) to a closed position, wherein the FTIV is arranged between the canister and a fuel tank.

5. The method of claim 2, further comprising deactivating a pump of the ELCM.

6. The method of claim 1, wherein adjusting the position of the valve comprises adjusting the valve to a closed position in response to a vacuum of the ELCM being less than or equal to a threshold vacuum.

7. The method of claim 1, further comprising generating the request to clean the orifice of the ELCM in response to a vacuum of the ELCM being greater than a threshold vacuum.

8. The method of claim 1, further comprising drawing contaminants to an intake manifold via an engine vacuum.

9. The method of claim 1, wherein the adjusting occurs during engine idle.

10. A system, comprising:

a fuel system comprising a fuel tank and a fuel vapor canister;

a fuel tank isolation valve (FTIV) arranged between the fuel vapor canister and the fuel tank;

a canister purge valve (CPV) arranged between the fuel vapor canister and an intake manifold of an engine;

an evaporative leak control module (ELCM) arranged between the fuel vapor canister and an ambient atmosphere;

a canister bypass passage arranged between the ELCM and the intake manifold, wherein a cleaning valve is arranged in the canister bypass passage; and a controller comprising computer-readable instructions stored on non-transitory memory thereof that when executed cause the controller to:

adjust a position of the cleaning valve to a partially open position in response to a request to clean an orifice of the ELCM based on a vacuum of the ELCM being greater than a threshold reference vacuum.

11. The system of claim 10, wherein contaminants from the ELCM flow to the intake manifold via an engine vacuum during an engine vacuum event.

12. The system of claim 11, wherein the engine vacuum event is an engine idle.

13. The system of claim 10, further comprising a pressure sensor arranged in the ELCM and configured to sense a pressure of the ELCM, wherein the position of the cleaning valve is adjusted to a fully closed position in response to the vacuum of the ELCM being less than or equal to the threshold reference vacuum.

14. The system of claim 10, wherein the instructions further enable the controller to close the FTIV and the CPV.

15. The system of claim 10, wherein the instructions further enable the controller to adjust the position of the cleaning valve to the partially open position in response to a leak test not being passed.

16. A system for an engine, comprising:

an evaporative leak check module (ELCM) arranged between a canister and atmosphere or a dust box;

a passage extending from a vent line to an intake manifold, wherein the vent line is arranged between the ELCM and the canister;

a valve arranged in the passage configured to connect a reference orifice of the ELCM to the intake manifold; and a controller comprising computer-readable instructions stored on non-transitory memory thereof that when executed cause the controller to:

adjust a position of the valve to flow vacuum from the intake manifold to the ELCM in response to a request to clean an orifice of the ELCM.

17. The system of claim 16, wherein the instructions further cause the controller to adjust the position of the valve in response to a leak test not being passed.

18. The system of claim 16, wherein the instructions further cause the controller to adjust the position of the valve to a partially open position.

19. The system of claim 16, wherein the instructions further cause the controller to adjust the position of the valve to a closed position in response to a pressure of the ELCM being less than or equal to a threshold reference pressure.

20. The system of claim 19, wherein the instructions further cause the controller to execute a leak test following adjusting the position of the valve to the closed position.

* * * * *